US007003841B2

(12) United States Patent
Mayer

(10) Patent No.: US 7,003,841 B2
(45) Date of Patent: Feb. 28, 2006

(54) SURFACE TREATING MACHINE

(75) Inventor: Heinrich Mayer, Muenchwilen (CH)

(73) Assignee: JohnsonDiversey, Inc., Sturtevant, WI (US)

( * ) Notice: Subject to any disclaimer, the term of this patent is extended or adjusted under 35 U.S.C. 154(b) by 315 days.

(21) Appl. No.: 10/122,729

(22) Filed: Apr. 15, 2002

(65) Prior Publication Data

US 2002/0178521 A1 Dec. 5, 2002

(30) Foreign Application Priority Data

May 31, 2001 (EP) ..... 01202076

(51) Int. Cl.
*A47L 11/00* (2006.01)

(52) U.S. Cl. ..... 15/49.1; 15/50.2; 15/50.3; 15/98

(58) Field of Classification Search ..... 15/49.1, 15/50.3, 50.2, 98, 230, 340.3; 403/227; 451/353
See application file for complete search history.

(56) References Cited

U.S. PATENT DOCUMENTS 6,023,813 A 2/2000 Thatcher et al.
6,163,915 A 12/2000 Kaczmarz et al.

FOREIGN PATENT DOCUMENTS

EP 0 189 617 10/1991
EP 0 910 981 A1 4/1999
EP 0 935 027 8/1999
WO 97/08984 3/1997

OTHER PUBLICATIONS

European Search Report dated Nov. 9, 2001.

*Primary Examiner*—John Kim
*Assistant Examiner*—Abraham Bahta
(74) *Attorney, Agent, or Firm*—Neil E. Hamilton; James J. Sales; Renee J. Rymarz

(57) ABSTRACT

The invention relates to a surface treating machine, comprising: a frame (1) and a chassis (2, 3) to enable the machine to move over a surface (S) such as a floor. A head (5) is supported by the frame and comprises means (6) for directly contacting, scrubbing or maintaining said surface. The head (5) is freely movable up and down with respect to the chassis (2, 3) and is loaded downwardly by a pressure to adapt to the level of the surface. At least a part of the pressure on the head (5) is derived from the weight of the machine itself. Preferably, the head (5) is connected to a first lever arm (8) of a two armed lever (7) A second arm (9) of the lever (7) is connected to the chassis (2, 3), whereas a pivoting point (10) of the lever (7) is fixed to the frame (1) of the machine. In this way, the pressure on the head is not only provided by the weight of the machine, but the head is also easily adapting to ramps and descents in the surfaces, while the pressure on the head is maintained.

6 Claims, 2 Drawing Sheets

SURFACE TREATING MACHINE

The present invention relates to a surface treating machine having a head adaptable to the level of a surface.

In the prior art there are various machines for treating surfaces, which include heads that are freely movable up and down and are loaded downwardly so as to adapt to the level of the surface. Examples thereof are shown in EP-A-0 935 027 and EP-A-0 189 617. In these machines, the pressure on the head is a result of the weight of the head and, if necessary, of additional pressure means such as springs.

The object of the present invention is to provide a novel surface treating machines of the type mentioned.

For this purpose, the surface treating machine according to the invention is characterized in that at least a part of the pressure on the head is derived from the weight of the machine itself.

According to the invention, the pressure on the head is increased substantially and might be sufficient for all kinds of treatments of the surface. Additional pressure means such as springs may be used to vary the pressure, if desired.

Preferably, the head is pivotally connected to the frame which makes it easier to follow the descents and ramps in the surface, particularly if the head is positioned in front of the undercarriage.

It is advantageous if the head is connected to a first arm of a two armed lever which is loaded by the weight of the machine, wherein preferably the second arm of the lever is connected to the chassis, whereas a pivoting point of the lever is fixed to the frame of the machine.

In this manner the weight of the machine is distributed among the head and (a part of) the chassis. In fact, the machine is partly supported by the head as a result of balancing the pivot point at the frame and depending on the length of both lever arms. As this system can freely move around the pivot point at the frame it follows descents and ramps in the surface while maintaining the pressure on the head. The structure and dimensions of the lever can be chosen such that a desired pressure is exerted on the head, which remains more or less constant when the lever is pivoted within a limited range. As mentioned before, it is however possible to provide additional means, such as springs or other loading means to vary the pressure on the head of the machine.

The invention will hereafter be further explained with reference to the drawings showing an embodiment of the surface treating machine according to the invention.

The drawings show a surface treating machine, in this case a so called scrubber dryer machine used to clean large area floors in buildings. It should be understood that the invention can be used in all kinds of other machines for treating or maintaining surfaces.

Figure 2:
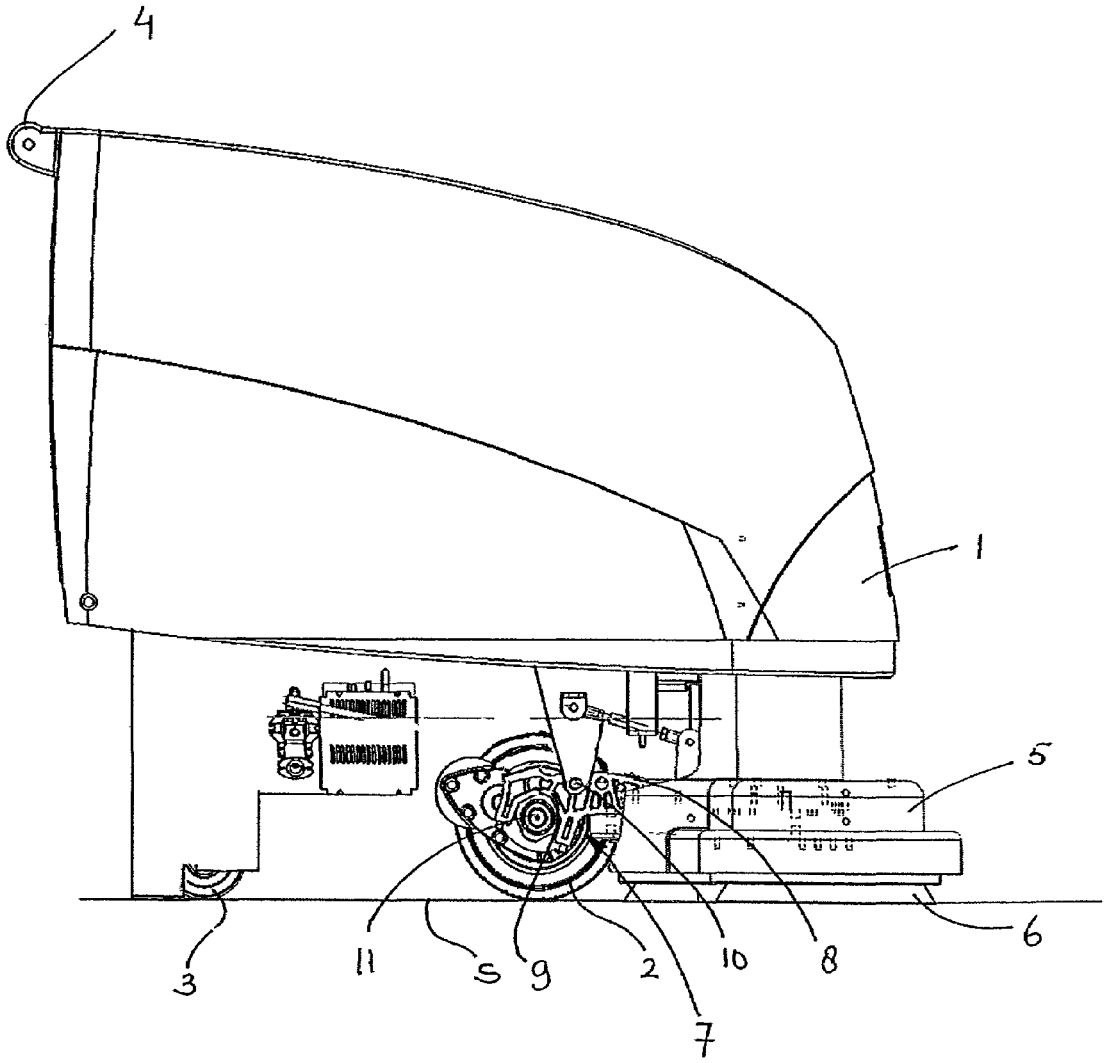
FIG. 2 is a schematic side view of a scrubber drier machine according to the present invention.

The machine comprises a body or frame 1 and a chassis 2, 3 to enable the machine to move over a surface or floor S. The chassis includes in this case one or two front wheels 2 and one or two rear wheels 3. In use, an operator is guiding the machine and is steering it through a handle or bar 4 (FIG. 2), but the machine can also have a seat for a driver and drive means to move the machine.

The machine further comprises a head 5 including any kind of tool, in this case scrubber means 6 to act on the floor S. The scrubber means 6 is rotatably driveable around an axis perpendicularly to the lower surface of the scrubber means 6. A drive motor (not shown) is provided to rotate the scrubber means 6. The head 5 is positioned in front of the front wheels 2 of the machine.

The head 5 is supported by the frame 1 in a manner so as to be freely moveable up and down in order to follow slopes and other irregularities in the surface S to be scrubbed.

In order to enable the head 5 to move, it is attached to the free end of a first lever arm 8 of a two armed lever 7. This lever 7 is attached to the frame 1 through a pivot 10 which is positioned between the first lever arm 8 and a second lever arm 9. These lever arms 8, 9 are positioned at an angle with respect to each other. The free end of the second arm 9 is connected to an axle 11 of the front wheels 2 of the machine.

Due to this arrangement, the weight at the front side of the machine is distributed among the front wheels 2 and the head 5, so that the head 5 is loaded downwardly against the floor and will exert a pressure on the scrubber means 6. The amount of pressure on the scrubber means 6 is a result of the pressure exerted by the machine on the two armed lever 7 and the (horizontal) length ratio of the first and second arms 8, 9. The design could be such that a desired pressure (i.e. 60 kg of weight) is exerted and it is also possible to provide some kind of adjustment to regulate the pressure, for example by shifting the pivot 10 along the lever, or adding further pressure by means such as adjustable and/or unadjustable springs or other means to apply force. Some of the pressure on the head 5 will also be caused by the weight of the head 5, but at least a part of the weight of the head 5 is countered by the weight of the front axle and wheels 2, which are connected to the second lever arm 9 of the lever 7, i.e. on the other side of the pivot 10.

Figure 1:
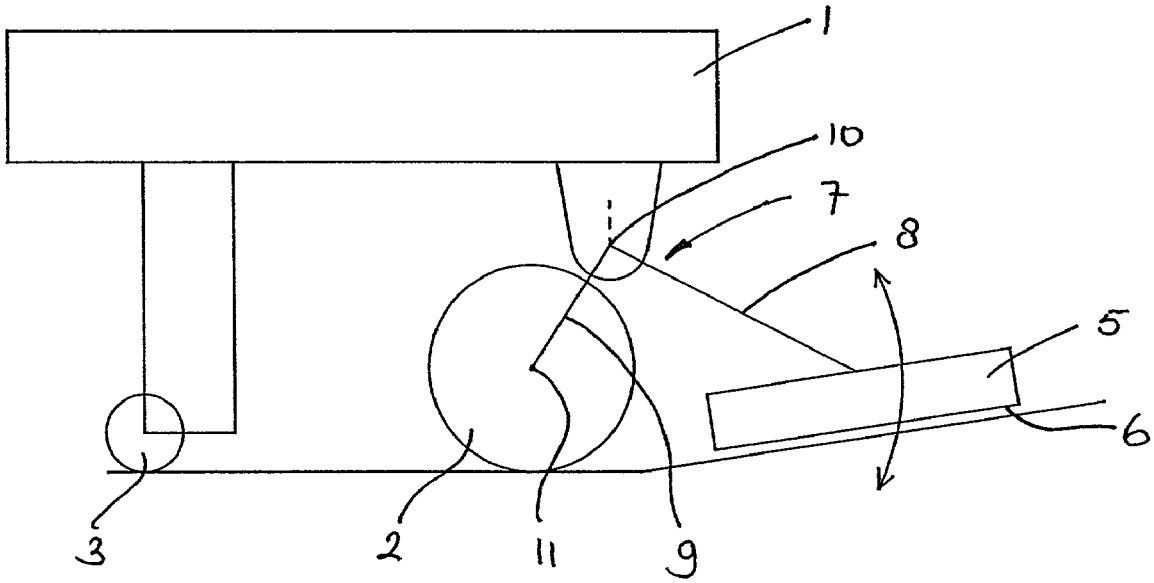
FIG. 1 is a very schematic sketch of a surface treating machine illustrating the principle of the present invention.

As is shown in FIG. 1, the head 5 is able to automatically follow a slope in the surface S by pivoting around the pivot 10 of the lever 7. Due to the rotation of lever 7, the front wheels 2 will be moved as well, but the wheels 2, 3 and the head 5 will always remain in contact with the surface S and the pressure on the head 5 will remain substantially constant, so that the efficiency of the machine will not be affected by slopes in the surface S.

From the foregoing it will be clear that the present invention provides a surface treating machine, the head of which is able to follow slopes in the surface while a substantially constant pressure on the head is maintained without any active regulation. As a result, the machine is enabled to operate efficiently under all surface conditions on the one hand, whereas the machine is simple and robust on the other hand.

Lifting and lowering of the tool of the head can easily be done by moving the system consisting of wheels, levers and head around the pivot 10 at the frame by using mechanical or motorised means.

The invention is not limited to the embodiment shown in the drawing and described herein before and may be varied in different manners within the scope of the invention.

What is claimed is:

1. A surface treating machine, comprising:

a frame (1) and a chassis (2, 3) to enable the machine to move over a surface (S) including a floor;

at least one axle having wheels connected to the chassis;

a head (5) pivotally connected to the frame by a first lever arm (8) of a two armed lever (7) and supported by the frame, the head comprising means (6) for directly contacting, scrubbing or maintaining said surface, a second arm (9) of the two armed lever connected to the axle;

the head (5) being freely movable up and down with respect to the chassis (2, 3) and is loaded downwardly by a pressure to adapt to the level of the surface;

characterized in that at least a part of the pressure on the head (5) is pivotally derived from the weight of the machine composed of the frame and chassis, and part of the weight of the machine is pivotally distributed to the axle.

2. A machine according to claim 1, wherein a second arm (9) of the two armed lever (7) is connected to the chassis (2, 3), whereas a pivoting point (10) of the two armed lever (7) is fixed to the frame (1) of the machine.

3. A machine according to claim 2, wherein the chassis (2, 3) comprises at least two axles having wheels, the second arm (9) being connected to one of the axles.

4. A machine according to claim 2, wherein the head (5) is positioned in front of the frame (1) of the machine and the two armed lever (7) is connected to a front axle (11) of the chassis (2, 3).

5. A machine according to claim 2, wherein the first lever arm (8) and second lever arm (9) have a distinct length-ratio which varies, depending on machine weight, tool pressure and longitudinal position of a front axle of the machine.

6. A machine according to claim 2, wherein the first and second lever arms (8, 9) are positioned at an angle with respect to each other.

* * * * *